US006283906B1

(12) United States Patent
Kostiza

(10) Patent No.: US 6,283,906 B1
(45) Date of Patent: Sep. 4, 2001

(54) FOLDING JAWS CYLINDER

(75) Inventor: Simon Kostiza, Fussgönheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/319,944

(22) PCT Filed: Dec. 19, 1997

(86) PCT No.: PCT/DE97/02984

§ 371 Date: Aug. 13, 1999

§ 102(e) Date: Aug. 13, 1999

(87) PCT Pub. No.: WO98/28139

PCT Pub. Date: Jul. 2, 1998

(30) Foreign Application Priority Data

Dec. 21, 1996 (DE) ..... 196 53 803

(51) Int. Cl.[7] ..... B31F 1/08

(52) U.S. Cl. ..... 493/424; 493/442; 493/476

(58) Field of Search ..... 493/424, 425, 493/434, 442, 426, 476

(56) References Cited

U.S. PATENT DOCUMENTS 5,057,064 10/1991 Michalik .
5,201,701 * 4/1993 Roettger et al. .
5,215,014 6/1993 Burger et al. .
5,417,642 5/1995 Boronka et al. .
5,429,578 * 7/1995 Calbrix et al. .
5,653,429 * 8/1997 Michalik et al. .
5,846,177 * 12/1998 Mayr .
5,924,970 * 7/1999 Wingate .

FOREIGN PATENT DOCUMENTS

2537920 A1 3/1977 (DE) .

* cited by examiner

*Primary Examiner*—Eugene Kim
(74) *Attorney, Agent, or Firm*—Jones, Tullar & Cooper, PC

(57) ABSTRACT

A folding jaw cylinder utilizes folding jaw pairs that automatically adjust the folding gap between the two jaws in each pair in response to the thickness of the folded product. A dual working chamber piston-cylinder unit is placed between first and second rotational carriers of the folding jaw members. One of the chambers is filled with liquid and is linked to a hydraulic accumulator by ways of a flow control valve. The second chamber is provided with compressed air.

7 Claims, 3 Drawing Sheets

1
2
3
4
5
6
7
8
9
11
12
13
14
16
17
18
19
21
22
23
24
26
27
32
39
40
41
42
43
44
46
47
48
49
51
52
II
III
IV

FOLDING JAWS CYLINDER

FIELD OF THE INVENTION

The present invention relates to a folding jaw cylinder for a folding apparatus of rotary printing presses.

A gap between the folding jaw elements can be set in accordance with the thickness of the product to be processed and can be automatically adjusted.

DESCRIPTION OF THE PRIOR ART

A folding jaw cylinder with a device for adjusting the folding gap in accordance with the thickness of the product to be folded is known from DE 25 37 920 A1. This adjustment is performed in that initially a sliding element with inclined faces is moved by means of a threaded spindle, which is supported on a threaded bushing and which extends in the axial direction of the cylinder. Thereafter, hingedly seated plungers extending in the radial direction of the cylinder are actuated by means of the inclined faces.

However, in connection with this prior art folding jaw cylinder it is disadvantageous that during the start-up of, for example, a collection production with triple collection, it loses the products as often, i.e. two or three times, as the preset folding jaws receive a product of a final product thickness.

Document EP-A 0 352 625 describes a folding jaw cylinder with at least one folding jaw having two folding jaw elements, wherein a gap between these foldingjaw elements can be adjusted to the thickness of products to be processed. This folding jaw cylinder additionally has a device, consisting of a measuring device and servo motors, for the adjustment ofthe gap between the folding jaw elements.

SUMMARY OF THE INVENTION

It is the object of the present invention to produce a folding jaw cylinder.

In accordance with the invention, this object is attained by the provision of a folding jaw cylinder with two folding jaw elements that are spaced apart at a gap distance. This gap distance can be set to a thickness of the products to be processed. A device for accomplishing the automatic adjustment of the gap distance or thickness between the folding jaw elements is provided.

The advantages which can be achieved in particular by means of the present invention reside in that in its basic position the folding jaw opening is adapted automatically to the product thickness. This means that the thickness of a folding product taken over by the folding jaws at the start-up of multiple collection production is "sensed".

In this way, regardless of its thickness, each folding product is individually grasped, for example during the start-up of a production of multiply-collected folding products, in such a way that its sliding out of the folding jaw openings is prevented.

BRIEF DESCRIPTION OF THE DRAWINGS

A preferred embodiment of the present invention is represented in the drawings and will be described in greater detail in what follows.

Shown are in.

BRIEF DESCRIPTION OF THE DRAWINGS

Figure 1:
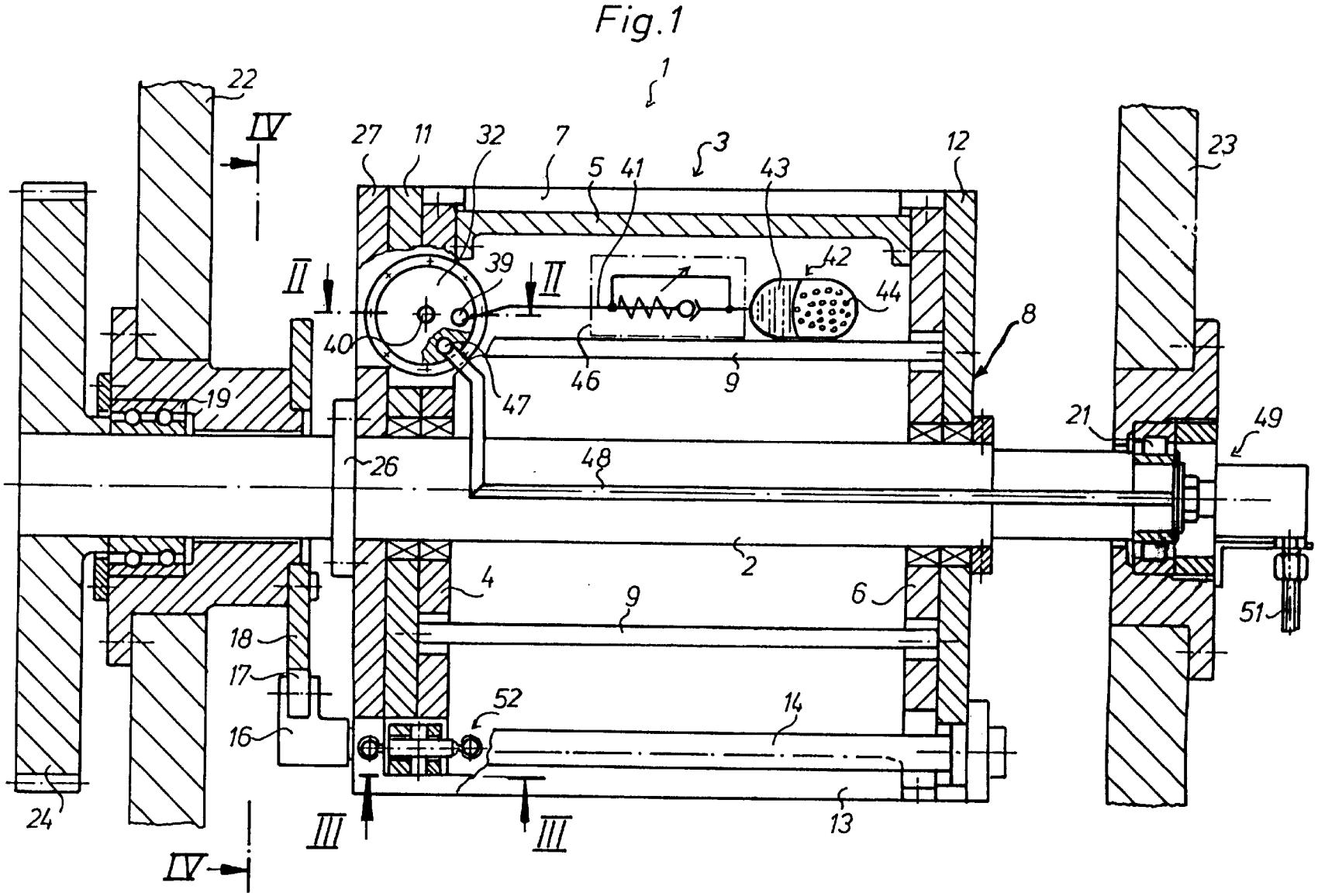
FIG. 1, a schematic representation of a longitudinal section through a folding jaw cylinder, approximately corresponding to the line I—I in FIG. 4, FIG. 2, a section II—II in accordance with FIG. 1 with an enlarged representation of a diaphragm cylinder-piston unit.
Figure 4:
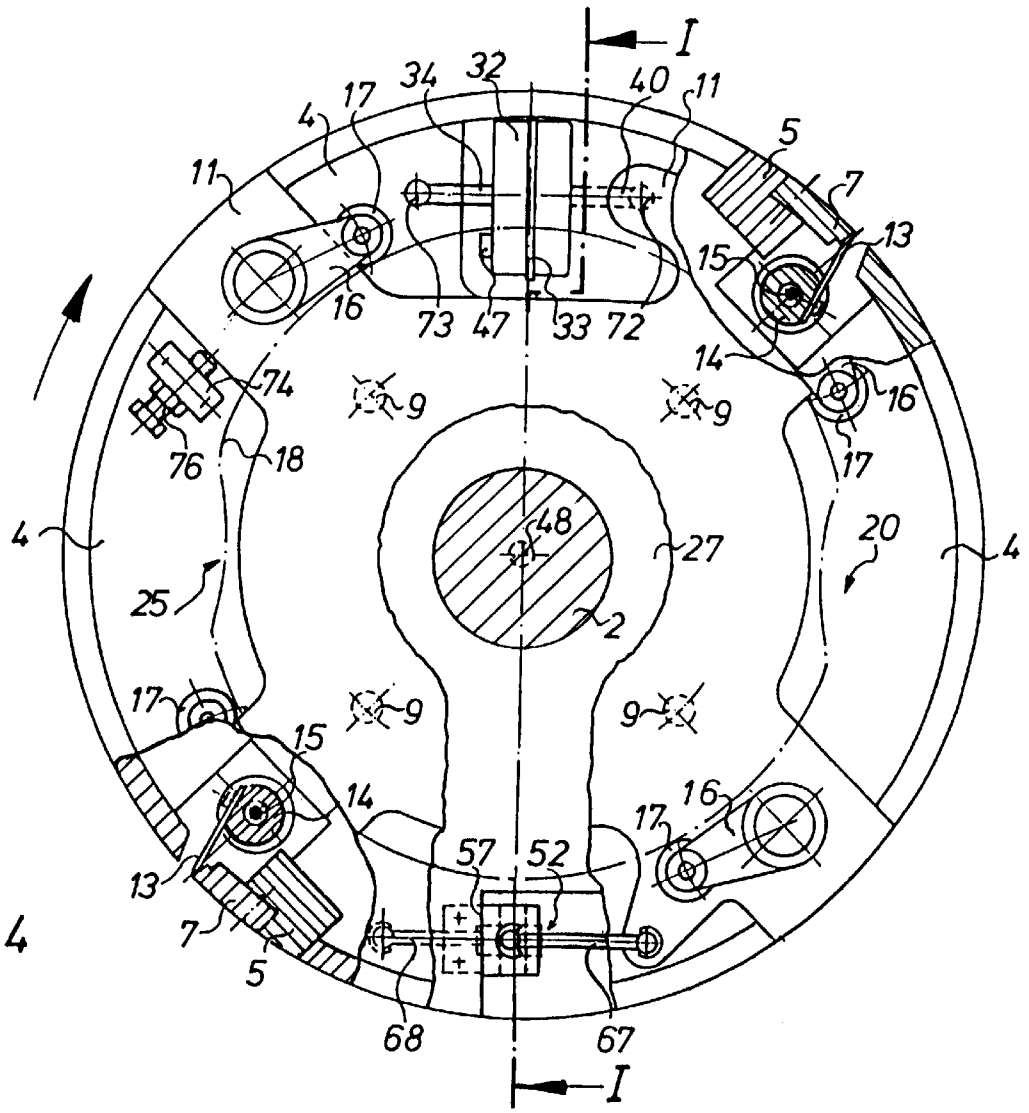
FIG. 4, a cross section IV—IV through the folding jaw cylinder in accordance with FIG. 1.

In a known manner, a folding jaw cylinder 1 consists of a first support body 3, which is rotatably seated on a shaft 2 and has two inner lateral disks 4, 6 embodied as solid disks. The inner lateral disks 4, 6 are spaced apart and connected with each other by, for example four cross bars 5, which receive fixed folding jaw elements 7 evenly distributed over the circumference of the disks. The folding jaw cylinder 1 furthermore has a second support body 8, which is also rotatably seated on the shaft 2. The second support body 8 is formed by two outer lateral disks 11, 12, which are spaced apart from each other and are maintained at cylinder width by a number of supports 9. The outer lateral disks 11, 12 are partially cut open as may be seen in FIG. 4. On its circumference, this second support body 8 contains, for example, four controllable folding jaw elements 13, which are also evenly spaced. These folding jaw elements 13 are each respectively fastened, for example next to each other, on a spindle 14, seated fixed in place on the support body. At one end, the spindle 14 projects out of the support body 8 and is connected via a lever arm 16 and a cam roller 17 with a control cam 18, which is fixed in place on a lateral frame. The control cam 18 has a curve profile 20 for opening and a curve profile 25 for closing the folding jaw elements 7, 13. The control cam 18 is represented in dash-dotted lines, as seen in FIG. 4. A torsion bar 15 is, as seen in FIG. 4 located in the hollow spindle 14, one side of which is fastened on the disk 12 and the other side on the lever arm 16. In a simplified way, as seen in FIG. 1, the position of the folding jaw elements 7, 13 is represented offset by 45° in respect to the position of the folding jaw elements 7, 13 in FIG. 4.

The shaft 2 of the folding jaw cylinder 1 is seated in lateral frames 22, 23 and is rotatable by means of rolling bearings 19, 21. On one end, the shaft 2 is connected, fixed against relative rotation, with a drive gear wheel 24. The drive gear wheel 24 meshes with a drive gear wheel, not represented, of a collection cylinder, for example.

On the drive side, the shaft 2 has a collar 26 between the lateral frame 22 and the folding jaw cylinder 1. The collar 26 is connected, fixed against relative rotation, with a drive disk 27, for example by means of screws. The drive disk 27 extends parallel with the outer lateral disk 11 of the second support body 8 and rests against it as may be seen in FIG. 1.

Figure 2:
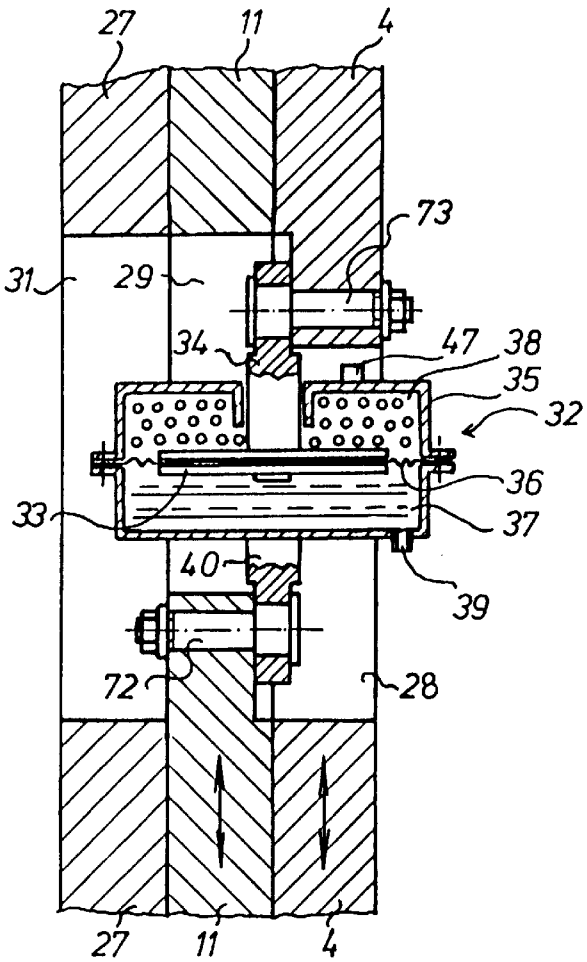

The lateral disks 4, 11, as well as the drive disk 27 each have a respective first recess 28, 29, 31, preferably on the drive side of the folding jaw cylinder 1, as may be seen in FIG. 2. A work cylinder 32, for example a double-action cylinder-piston unit 32, 33, is arranged in the recess 28, 29, 31. The work cylinder 32 is connected with the outer lateral disk 11 by means of a holder 40, attached to its housing 35, and a screw 72. The free end of the piston rod 34 is connected via a screw 73 with the inner lateral disk 4.

The cylinder-piston unit 32, 33 is suitably designed as a diaphragm cylinder. This means, for example, that the piston 33 is embodied in a disk shape and has a circular ring-shaped diaphragm 36 on its periphery. The diaphragm 36 is fixed in place by its exterior circumference on the housing 35 of the cylinder 32. This can be achieved by clamping it in place between two housing elements, for example. In this way a gas- and liquid-proof separation is achieved between a first chamber 37 of the cylinder 32 and a second chamber 38 of the cylinder 32. A piston stroke of this cylinder 32 is only a few millimeters, as shown in FIG. 2.

The first chamber 37 is filled with a pressure medium 43, for example hydraulic fluid. The first chamber 37 is connected via an outlet connector 39, as well as a line 41, with a known energy accumulator, for example a hydraulic reservoir 42, which is fastened, for example on a support 9 of the second support body 8, all as seen in FIG. 1. On the side close to the line 41, the hydraulic reservoir 42 contains a fluid such as the pressure medium 43, and a gas 44 in an expandable, or respectively compressible plastic bag. This gas can be air or nitrogen.

A throttle check valve 46 is arranged between the first chamber 37 of the cylinder 32 and the hydraulic reservoir 42 and acts in the direction toward the hydraulic reservoir 42.

The second chamber 38 of the cylinder 32, filled with the gas 44, of the cylinder 32 is connected via an outlet connector 47, as well as a line 48, with a compressed air source, not represented. Here, the line 48 first extends inside the shaft 2. A known rotary inlet 49 located at the shaft end makes a connection with a line 51 continuing to the compressed air source, as may be seen in FIG. 1.

Figure 3:
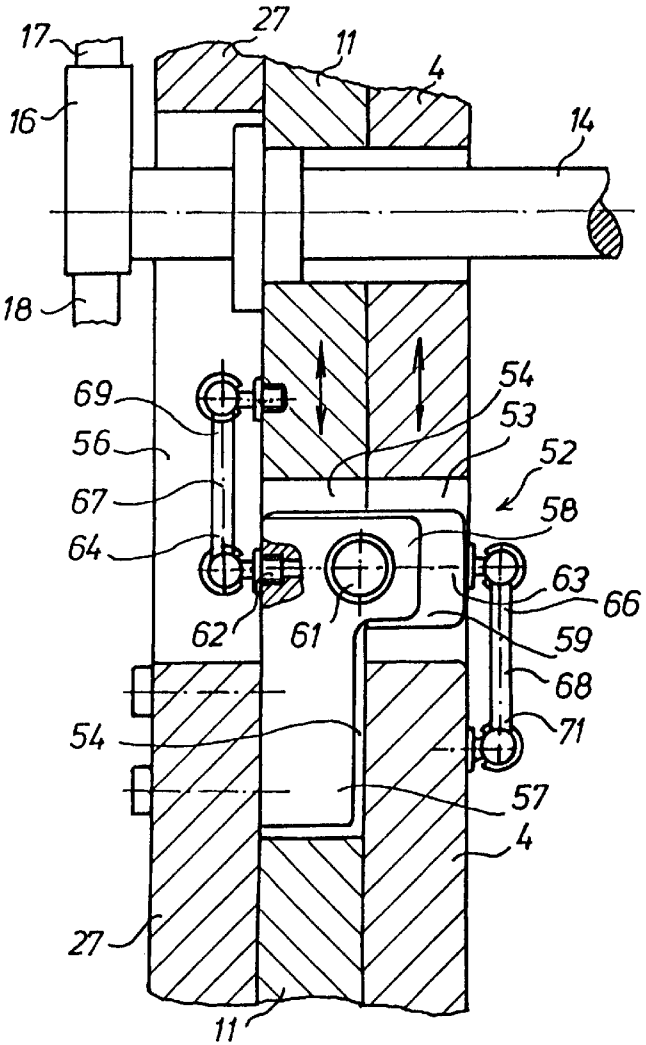
FIG. 3, a section III—III in accordance with FIG. 1 with an enlarged representation of a synchronizing device.

A synchronization device 52 is located in a second recess 53, 54, 56 of the disks 4, 11, 27 as seen in FIG. 3. The synchronization device 52 is located approximately diametrically opposite the cylinder-piston unit 32, 33 and can be arranged on the drive disk 27.

The synchronization device 52 consists of a synchronizing coupled gear. At one end of its recess 56, the drive disk 27 is fixedly connected with an L-shaped bearing block 57. The shorter leg of the bearing block 57 is made fork-shaped. A two-armed lever 59 is guided in the fork 58, which is seated centered on a bearing bolt 61. The bearing bolt passes through the fork 58 in the radial direction toward the lateral disk 4, 11. The ends 62, 63 of the two-armed lever 59 are hingedly connected with first ends 64, 66 of couplers 67, 68. A second end 69 of the coupler 67 is hingedly connected at the end of the recess 54 with the outer lateral disk 11 of the second support body 8 of the folding jaw cylinder 1. A second end 71 of the second coupler 68 is hingedly connected in the opposite direction from the second end 69 of the first coupler 67 at the end of the recess 53 with the inner lateral disk 4 of the first support body 3. The couplers 67, 68 extend in the shape of a secant in respect to the lateral disks 11, 4.

In the top view shown in FIG. 3, the synchronization device 52 consisting of the two-armed lever 59 and the two hinged couplers 67, 68 represents a reflected letter Z.

The function of the folding jaw cylinder is as described in what follows. In the course of drawing a paper web into a rotary printing press, or respectively an associated folding apparatus, the folding jaw cylinder 1 turns at a low number of revolutions, i.e. at creep speed. Since there are no products yet to be received in the folding gaps defined by the fixed and controllable folding jaw elements 7, 13, the compressed air supplied to the second chamber 38 of the cylinder-piston unit 32, 33 causes the fluid 43 located in the first chamber 37 to slowly flow into the hydraulic reservoir 42 via the line 41, as well as through the throttle check valve 46 acting in the throttling direction. In this case, the air pressure is approximately 3 to 6 bar and is higher than the pressure acting in the first chamber 37. In place of the chamber 38 charged with compressed air, the counterforce can also be generated by a spring. Because of this, the two support bodies 3, 8, and therefore the folding jaw elements 7, 13, move toward each other in opposite directions until a preset gap of a minimum width of, for example, 0.1 mm, constituting a basic setting, has been reached.

This minimum width gap can be preset by means of a stop. For example, the stop consists of a bearing block 74, which receives a lockable screw 76 and is fastened on the lateral disk 4. One end of the screw 76 cooperates with the lateral disk 11, all as may be seen in FIG. 4.

As soon as a first product has been transferred by a collecting cylinder to the folding jaw cylinder 1, the movable folding jaw elements 13 are controlled via the cam gear 14, 16, 17, 18 so that they close. Ih the course of this closure, a force is generated between the folding jaw elements 7, 13, which force pushes the folding jaw elements 7, 13 apart. This jaw separating force is generated in accordance with the thickness of the product. In other words, as the thickness of the product placed between the jaw elements 7, 13 increases, as would occur in collect production, the jaw separating force is increased.

This product thickness related jaw separating force, generated by the product thickness and acting on the work cylinder 32 works, together with the force of the first chamber 37, against the force of the second chamber 38. In the process, the fluid 43 is rapidly drawn from the hydraulic reservoir 42 to the first chamber 37 of the cylinder-piston unit 32, 33 without a throttling effect of the throttle check valve 46. But a return movement of the piston 33 in the direction of the second chamber 38 filled with compressed air only takes place as far as the counterforce of the compressed air supplied via the rotary inlet 49 will permit.

After the removal of the folded product from the folding jaw elements 7, 13 of the folding jaw cylinder 1, the product thickness related jaw separating force provided by the folded products no longer exists. The air pressure provided via the rotary inlet 49 acts on the piston 33 of the cylinder-piston unit 32, 33. Now, the fluid 43 in the first chamber 37 tries to run back into the hydraulic reservoir 42 against the direction of the throttling effect of the throttle check valve 46. But this is restricted depending on the setting of the throttle check valve 46, for example because it is necessary that a thicker product must be picked up by the next following folding jaw elements 7, 13. As a result, a product thickness related jaw separating force is again created between the folding jaw element 7, 13 after closing. Therefore the first and second support bodies 3, 8 turn further apart. In the course of this, the piston 33 moves in the direction of the second chamber 38 filled with compressed air, until the cam roller 17 has reached the highest point of the control cam 18 and the folding jaw elements 7, 13 are closing again. In the process the fluid 43 in the first chamber 37 again tries to run off into the hydraulic reservoir 42 against the direction of the throttling effect of the throttle check valve 46.

Thus, the first chamber 37 of the work cylinder 32, 33 is charged with a pressure medium 43, wherein the supply and removal of the pressure medium takes place with different amounts per unit of time (the supply takes place at a greater speed than the removal). Here, the speed of the supply is a multiple of, i.e. at least twice, the speed of the removal.

When, after several collections, the final thickness of the product has been reached, the folding jaws 7, 13 have been set to this thickness.

After increasing the rpm of the machine, a hydraulically, pneumatically or mechanically acting known blocking device can become automatically active, which fixedly connects the lateral disks 11, 4 with the drive disk 27.

The synchronization device 52 sees to an even setting of the folding jaw gap in both directions.

It is also possible to utilize a different gear with little play and less automatic locking for the synchronization device.

The work cylinder 32 can also be arranged between a support body and a folding jaw element, which is movable in relation to it, or between a control element, for example the cam roller 17, and the associated folding jaw element.

While a preferred embodiment of a folding jaws cylinder in accordance with the present invention has been set forth fully and completely hereinabove, it will be apparent to one of skill in the art that a number of changes to, for example, the type of printing press used, the type of transport of the printed products to folding jaw cylinder and the like could be made without departing from the true spirit and scope of the present invention which is accordingly to be limited only by the appended claims.

What is claimed is:

1. A folding jaw cylinder comprising:

at least one folding jaw having first and second folding jaw elements, said folding jaw elements defining a folding jaw gap;

means supporting said first and second folding jaw elements on the folding jaw cylinder for movement relative to each other to vary said folding jaw gap; and means for automatically adjusting said folding jaw gap between said first and second folding jaw elements, said means including at least one working cylinder, said at least one working cylinder having a first chamber connected to an energy accumulator, and means to supply a first pressure medium to said first chamber and to remove the first pressure medium from said first chamber at different amounts per unit of time.

2. The folding jaw cylinder of claim 1 further including a throttle check valve positioned between said first chamber of said working cylinder and said energy accumulator.

3. The folding jaw cylinder of claim 1 wherein said work cylinder can be charged with a counterforce.

4. The folding jaw cylinder of claim 3 wherein said work cylinder includes a second chamber and further wherein said counterforce is a second pressure medium supplied to said second chamber.

5. The folding jaw cylinder of claim 1 further including first and second moveable support bodies on said folding jaw cylinder, said first and second support bodies supporting said first and second folding jaw elements, said working cylinder being positioned between said first and second moveable support bodies.

6. The folding jaw cylinder of claim 1 further including a support body for a first one of said folding jaw elements and wherein said second one of said folding jaw elements is moveable with respect to said support body, said working cylinder being positioned between said support body and said moveable folding jaw element.

7. The folding jaw cylinder of claim 1 further including a control member for moving a first one of said folding jaw elements, said working cylinder being positioned between said control member and said moveable folding jaw element.

* * * * *